US009226060B2

(12) United States Patent
Minarik et al.

(10) Patent No.: US 9,226,060 B2
(45) Date of Patent: Dec. 29, 2015

(54) PERSONALIZED MODULAR HEADPHONE SYSTEM AND METHOD

(71) Applicant: Polk Audio, Inc., Baltimore, MD (US)

(72) Inventors: Ryan Minarik, Oceanside, CA (US); Kenneth Chae, Baltimore, MD (US)

(73) Assignee: Directed, LLC, Vista, CA (US)

( * ) Notice: Subject to any disclaimer, the term of this patent is extended or adjusted under 35 U.S.C. 154(b) by 225 days.

(21) Appl. No.: 14/093,368

(22) Filed: Nov. 29, 2013

(65) Prior Publication Data

US 2014/0177884 A1 Jun. 26, 2014

Related U.S. Application Data

(60) Provisional application No. 61/731,083, filed on Nov. 29, 2012.

(51) Int. Cl.
*H04R 1/10* (2006.01)
*H04R 5/033* (2006.01)

(52) U.S. Cl.
CPC ..... *H04R 1/1066* (2013.01); *H04R 1/105* (2013.01); *H04R 1/1041* (2013.01); *H04R 5/0335* (2013.01)

(58) Field of Classification Search
CPC .... H04R 1/1066; H04R 1/105; H04R 1/1041; H04R 5/0335
See application file for complete search history.

(56) References Cited

U.S. PATENT DOCUMENTS 4,302,635 A * 11/1981 Jacobsen et al. ..... 381/371
2003/0210801 A1* 11/2003 Naksen et al. ..... 381/370
2006/0159279 A1* 7/2006 Kuo et al. ..... 381/74

* cited by examiner

*Primary Examiner* — Ping Lee
(74) *Attorney, Agent, or Firm* — KC Bean, Esq.

(57) ABSTRACT

A modular headphone system and method of assembling a pair of headphones to satisfy individual personal fashion, comfort and performance preferences. The inventive headphone system is comprised of a plurality of modular interchangeable headphone components, each component being interchangeable and having a plurality of unique fashion, comfort or quality grade variations.

6 Claims, 3 Drawing Sheets

PERSONALIZED MODULAR HEADPHONE SYSTEM AND METHOD

CROSS-REFERENCE TO RELATED APPLICATIONS

This application claims the benefit of and is a continuation of U.S. Provisional Patent Application Ser. No. 61/731,083 filed Nov. 29, 2012 and titled PERSONALIZED MODULAR HEADPHONE SYSTEM AND METHOD.

BACKGROUND OF THE INVENTION

The present invention is in the field of audio headphones.

Audio headphones have long been a staple for audiophiles and for use in various listening applications where the noise elimination and the quality of the audio experience was crucial. With active lifestyles, trendy fashioning of many wearable items and the introduction of digital audio players and smart phones, the use of fashion audio headphones has continue to grow significantly. Audio headphones include for each ear an ear piece that houses the speaker driver. The ear piece can be over the ear pinna with an enclosure that covers the entire pinna of the outer ear and minimizes or prevents outside noise from entering the ear. The ear piece can also be an on-ear type, which sits on the ear pinna, without the enclosure or in-ear buds. The on-ear and over-the-ear ear piece is generally attached to a headband that can be adjusted to fit the head of the individual listener.

The ear piece drivers receive audio signals from an audio source. The source transmits the audio signal to the headphones through an audio cord that is shielded, usually covered with a thin plastic or rubberized material that is rugged and flexible. The cord having an electrical connector or jack at the terminal end for making electrical connection with the source player. The cord must be of a sufficient length to allow the headphones to reach the listener's ears while maintaining the source at a stable location such as in the user's pocket or clipped to the user's belt. The cord is now often replaced with a wireless communication means, such as local radio frequency transmitters. Bluetooth® is a common RF link that is used.

Like clothing or other fashion items, many listeners prefer to personalize, customize or otherwise accessorize their listening devices and headphones to uniquely reflect their own personal preferences and identity. Designing products with aspirational and lifestyle fashions statement accessories have allowed individualization of those products, including headphones. Variation in colors and material composition of components provides for a unique look and feel of products. Generally, the fashion design aspect of headphones is created by manufactures and not the individual end user listener. User simply select the desired fashion headphone that are made available by the manufacturer. Fashion headphones come fully constructed from the factory. The number of variations in the product's fashion design or quality components is dictated by the manufacturer based on popularity of the design and economic considerations regarding the expense of carrying a large number of product SKUs. This is a limitation of current fashion headphones.

Another limitation with current headphones is that when products come from the factory with completely fixed constructions in design there is little or no opportunity to upgrade or select components of different quality grade or price points. Many consumers may desire to select components that are best suited to the multiple applications in which the product will be used or that allow consumers to upgrade after the initial purchase. For example, at some times the user may listen while jogging; at other times he may be listening while flying on a plane. With fixed construction, two sets of headphones would be required.

BRIEF SUMMARY OF THE INVENTION

The disclosed embodiment of the current invention relates to an audio headphone system and method that provides easy substitution of fashion and functional headphone components. The objects of this invention is to provide novel solutions to overcome the limitation described relating to current audio headphone systems.

One object of the present invention is to provide an audio headphone system that allows a user to personalize, customize or otherwise accessorize headphones to uniquely reflect their own personal fashion preferences.

Another object of the invention is to provide an audio headphone system with components that are not permanently fixed in construction at the factory and that can be easily replaced or upgraded so that the components are simple to install instantly without tools or training in electronics.

It is yet another object of the invention to provide a method of customizing audio headphones to suit a listeners fashion and audio quality preferences.

DESCRIPTION OF THE INVENTION

The present invention is directed to a modular headphone system and method of assembling a pair of headphones to satisfy individual personal fashion, comfort and performance preferences. The inventive headphone system is comprised of a plurality of modular interchangeable headphone components, each component being interchangeable and having a plurality of unique fashion, comfort or quality grade variations. The method also provides for interchangeability of components to allow alternative use applications, such as over-the-ear, in-ear or on-ear applications. The inventive system and method allow for adapting different fashion styles or quality grades of speakers, headbands, colored cables, or different shaped or type of ear pieces.

Figure 1:
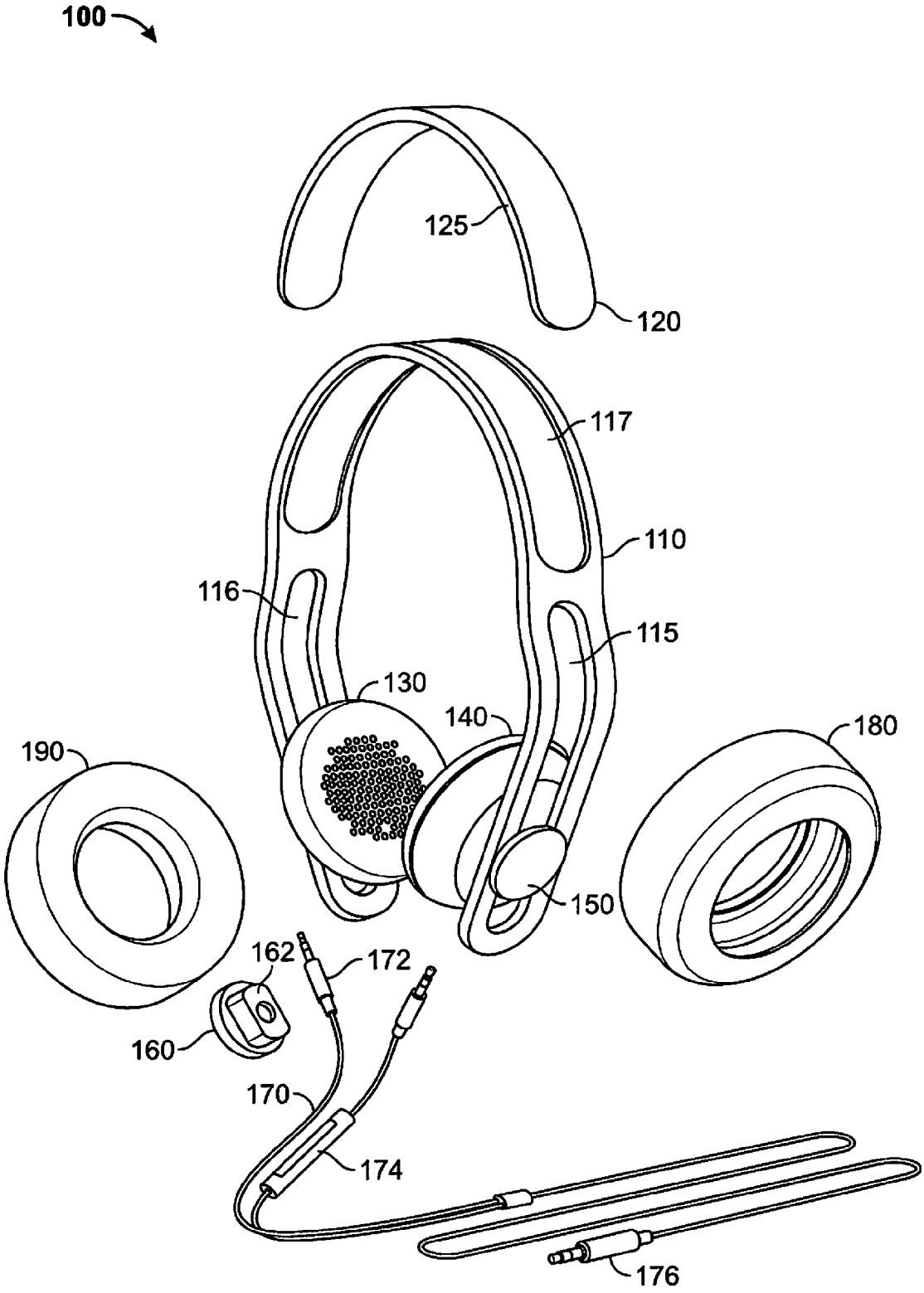
FIG. 1 is an exploded perspective view of the various components of the headphone system of the current invention.

Now with reference to the various figures. FIG. 1 shows an exploded view of the inventive headphone system 100. The headband 110 is generally arcuate in shape to conform to the listener's head shape, but can be of differing shape for wearing behind the head, attached to a hat, beanie, cap, helmet, or other head gear or accessory. The headband 110 can be constructed of various materials such as textured plastics or metals or covered with fabric or decals of any desirable patter. The headband 110 can also have first void portion 117 where a decorative plastic panel 120 can be inserted using a tongue and groove, the groove 125 at the outer edge of the panel and the tongue at the outer edge of the first void portion 117. It will be appreciated by one skilled in the art that the panel 120 can be composed of any material or include any aesthetic configuration that is desirable.

The headband 110 will also include a second void portion 115 and a third void portion 116. The second void portion 115 and the third void portion 116 each configured to accept a first ear piece 130 and a second ear piece 140 respectively. The first and second ear pieces 130, 140 can be round, square, triangular or essentially any desirable shape, and like the headbands can be made of different materials or covered with fabric or decals that are preferred. The first and second ear pieces 130, 140 can incorporate different audio drivers (not shown) of different construction or audio performance. The first and second ear pieces 130, 140 are factory configured to be of the on-ear type, but can be of the in-ear, on-ear or over the ear style. Alternatively, for use in different listening applications, an on-ear ear piece can be converted to an over-ear ear piece by coupling over-ear pads 180, 190 to the on-ear base plate of each ear piece. The coupling is accomplished by use of a tight fitting press-on over-ear pad. The over-ear pads is preferably a silicone rubber, but can be any suitable material that allows for firm attachment and comfortable wear. One of ordinary skill in the art will appreciate that there are a variety of well know means of fastening the ear pads, such as clips, fasteners, snaps, press ring, threads, Velcro and others.

The first and second ear pieces 130, 140 are slidably attached to the headband 110 by use of a snap fastener 150, 160 for each ear piece 130, 140 respectively. The snap fasteners 150, 160 are pressed on to the male end of the snap, shown on FIG. 2 as 250, which is constructed into the ear piece. The snap fasteners 150, 160 include a square shaped register 162 to properly align the snap fasteners 150, 160 within the second void portion 115 and the third void portion 116 of the headband 110 and allow for slidable movement of each ear piece up and down the length of each void 115, 116 respectively. The snap fasteners 150, 160 firmly attached their respective ear piece 130, 140 to the headband 110 at the desired location by way of tension contact between the snap fastener 150 and the ear piece 140. This allows the listener to adjust each ear piece on the headband for greatest wearing comfort.

Alignment of each ear piece on the headband is important to insure proper placement of an audio signal cord 170 for providing the audio signal from the source to each ear piece. The cord 170 will include male connectors 172 for connecting to female connectors within each ear piece (not show on FIG. 1). The female connectors are preferably located on the lower portion of the ear piece so that the male cord connectors 172 are inserted and the cord 170 drapes downward for a comfortable fit. Another male connector 176 is located on the opposite distal end of the cord 170 and used to connect with the audio source. The cord 170 may also include in-line controls 174 for adjusting various settings of the headphones 100.

Figure 2:
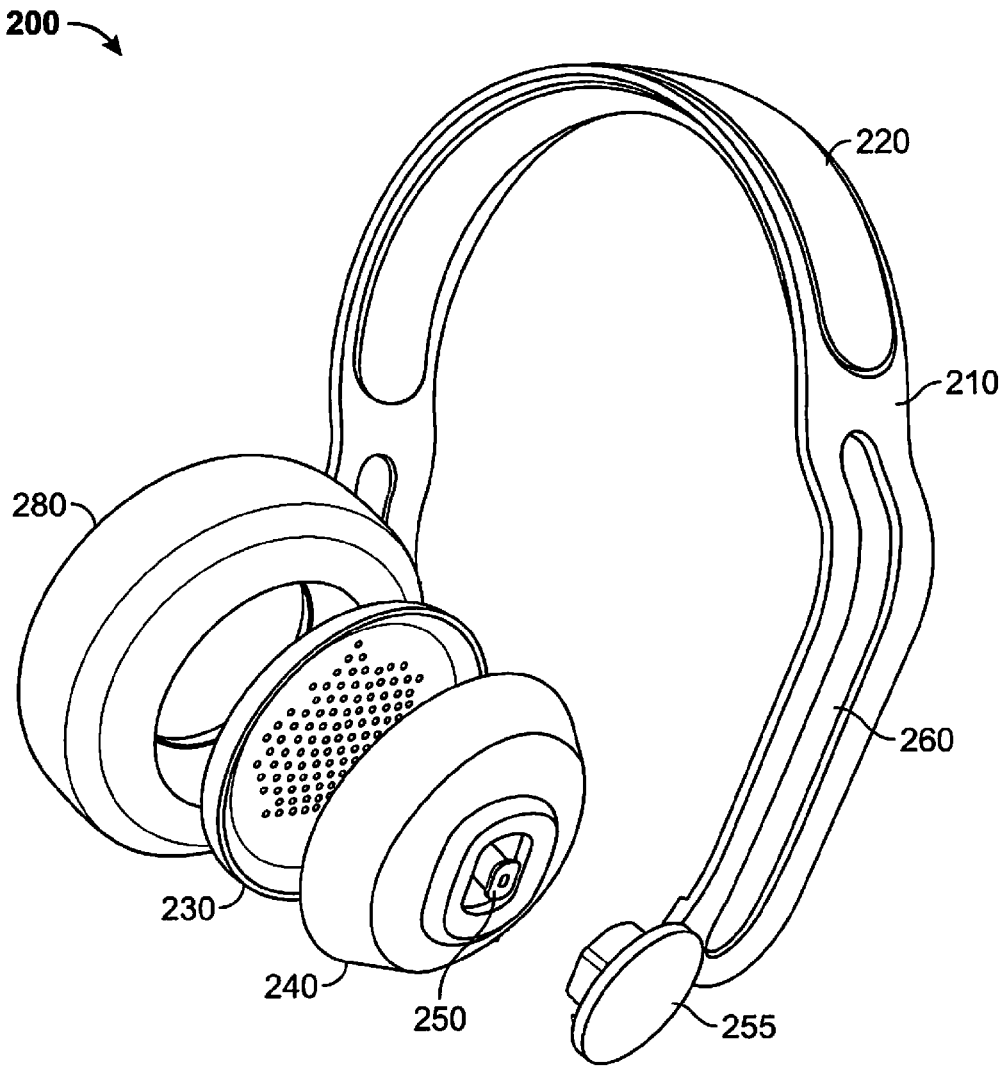
FIG. 2 is an exploded perspective view of the ear piece and headband of the current invention.

Now with further reference to FIG. 2. FIG. 2 is another exploded view of the disclosed embodiment of the invention. Disclosed is an illustrative embodiment of the inventive headphone system 200 showing the headband 210 with the decorative panel 220 in place on the headband. Attention is focused on the configuration of only one ear piece. The ear piece is comprised of housing with a mounting base 240 and a on-ear base plate 230. A speaker transducer (not shown) is secured within the housing. The mounting base 240 and the on-ear base plate 230 are secured together with a snap lock. However, any well known fastening means can be used to secure the mounting base 240 and the on-ear plate 230.

The assembled ear piece housing includes a snap press rod fastener 250 built into the ear piece to secure the ear piece to the headband 210. After insertion through the headband void 260, a snap female snap cap 255 is pressed on to a snap rod 250 to fastened the ear piece. The snap press rod fastener 250 is constructed from substantially rigid material. The female snap cap 255 is manufactured from a rigid but flexible material such as silicone that fits over the rod 250 and holds the ear piece to the headband 210. The ear piece is fitted through the gap 260 in the head band and a female snap cap 255 is fitted over the rod 250, holding the ear piece in place on the headband 210. The soft parts of the ear piece provide tilt and friction for height adjustment along the headband rails. If the listener prefers an over-ear ear piece, an over-ear pad 280 is press fitted over the on-ear base plate 230 by a tongue and groove.

Figure 3:
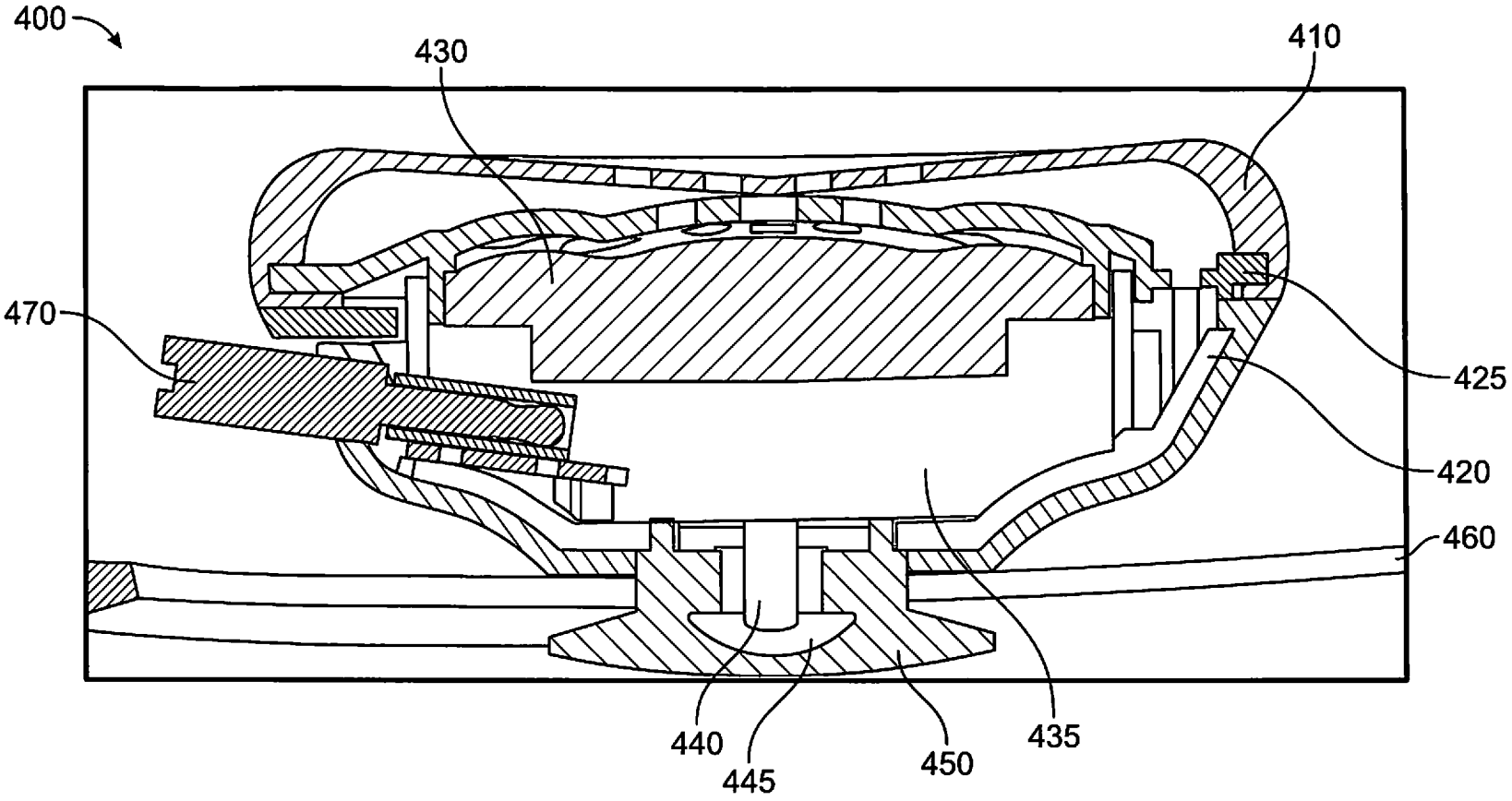
FIG. 3 is a sectional view of the ear piece showing the snapping fastening mechanism.

Now with reference to FIG. 3, shown is a cross section of one of the ear pieces 400 secured to the headband 460 by the female snap cap 450 press fitted over the snap rod 440 and rod head 445. A speaker driver 430 is secured within the ear piece by a molded fitting 435, which also include electrical connections for the driver 430. An audio signal and power is provided to the driver 430 through a connector 470. By providing a connector in the ear piece 470, the listener can disconnect the cord jack and replace the cord with a cord of any color or pattern of color, or replace the ear piece. The driver 430 is covered by the one-ear plate 410, which is secured to the ear piece mounting base 420 by a clip 425. An over ear pad (not show) can be press fit over the on-ear plate 410.

The present invention has been shown and described with reference to particular embodiments and it will be understood by those skilled in the art that various changes, variations, combinations, modification and equivalents may be substituted for elements of the invention without departing from the broad scope of the invention. In addition, many modifications may be made to adapt a particular situation or material to the teachings of the invention without departing from the essential scope the invention. It is intended that the invention not be limited to the particular embodiments disclosed herein, but that the invention will include all embodiments falling within the scope of the appended claims.

The invention claimed is:

1. A modular stereo headphone system comprising:

a semi-rigid headband having an arcuate upper portion having a first void, a first downward portion having second void and a second downward portion having a third void, wherein the first void portion is configured to receive a decorative member;

a first ear piece adjustably and removably secured to the headband at the second void, and a second ear piece adjustably and removably secured to the headband at the third void, wherein the first ear piece and the second ear piece are each further comprised of;

a connector, for accepting an audio jack in communication with an audio source, a speaker, for playing an audio signal received from said audio jack, an ear plate configured to receive a interchangeable over-ear pad, and a mounting base configured to secure the ear piece to the headband with a securing means, and wherein the speaker is removably secured within a cavity formed when the ear plate and mounting plate are releasably fixed together.

2. The modular stereo headphone system of claim 1, wherein the decorative member is selected from a plurality of interchangeable decorative members.

3. The modular stereo headphone system of claim 1 wherein the decorative member is secured to the headband by way of a tongue and groove.

4. The modular stereo headphone system of claim 1, wherein the speaker is selected from a plurality of interchangeable speakers.

5. The modular stereo headphone system of claim 1, wherein each ear piece is adjustably and removably secured to the headband by way compression tension provided by a snap fixture, wherein the snap fixture is comprised of rod secured within the mounting base and a cap press fitted over said rod.

6. The modular stereo headphone system of claim 1, wherein each ear piece is adjustably and removably secured to the headband by way compression tension provided by a screw fixture, wherein the screw fixture is comprised of threaded member within the mounting base and a threaded cap secured to said rod.

* * * * *